US008963440B2

(12) United States Patent
Jennings et al.

(10) Patent No.: US 8,963,440 B2
(45) Date of Patent: Feb. 24, 2015

(54) TWO-WIRE DIMMER SWITCH FOR CONTROLLING LOW-POWER LOADS

(71) Applicant: Lutron Electronics Co., Inc., Coopersburg, PA (US)

(72) Inventors: Jason Edward Jennings, Macungie, PA (US); Christopher James Salvestrini, Allentown, PA (US); John Panos Petropoulos, Emmaus, PA (US); Nicholas Robert Baer, Bethlehem, PA (US); Walter S. Zaharchuk, Macungie, PA (US); James P. Steiner, Royersford, PA (US); Andrew Ryan Offenbacher, Quakertown, PA (US); Robert C. Newman, Jr., Emmaus, PA (US); Mikko Hakkarainen, Palm Beach Gardens, FL (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 13/778,947

(22) Filed: Feb. 27, 2013

(65) Prior Publication Data

US 2013/0293137 A1 Nov. 7, 2013

Related U.S. Application Data

(60) Provisional application No. 61/642,879, filed on May 4, 2012.

(51) Int. Cl.
*H05B 37/02* (2006.01)

(52) U.S. Cl.
CPC ..... *H05B 37/02* (2013.01)
USPC ..... 315/224; 315/209 R; 315/291; 315/307; 315/308

(58) Field of Classification Search
USPC ..... 315/136, 209 R, 224, 291, 307, 308, 362
See application file for complete search history.

(56) References Cited

U.S. PATENT DOCUMENTS

| | | | | |
|---|---|---|---|---|
| 5,637,930 | A * | 6/1997 | Rowen et al. | 307/112 |
| 6,400,103 | B1 | 6/2002 | Adamson | |
| 7,868,561 | B2 | 1/2011 | Weightman et al. | |
| 7,906,916 | B2 | 3/2011 | Gehman | |
| 8,013,545 | B2 | 9/2011 | Jonsson | |
| 8,198,820 | B2 | 6/2012 | Weightman et al. | |
| 8,198,827 | B2 | 6/2012 | Gehman | |
| 8,242,714 | B2 | 8/2012 | Weightman et al. | |
| 2008/0315787 | A1 | 12/2008 | Xu | |
| 2011/0095687 | A1 | 4/2011 | Jonsson | |
| 2011/0095709 | A1 | 4/2011 | Diehl et al. | |
| 2011/0121752 | A1 | 5/2011 | Newman, Jr. et al. | |
| 2011/0121812 | A1 | 5/2011 | Salvestrini | |
| 2012/0033471 | A1 | 2/2012 | Newman, Jr. | |
| 2012/0230073 | A1 | 9/2012 | Newman, Jr. et al. | |

* cited by examiner

*Primary Examiner* — Douglas W Owens
*Assistant Examiner* — Thai Pham
(74) *Attorney, Agent, or Firm* — Condo Roccia Koptiw LLP

(57) ABSTRACT

A two-wire load control device such as a dimmer switch for controlling the amount of power delivered from an AC power source to an electrical load such as a high-efficiency lighting load may be provided. The load control device may include a bidirectional semiconductor switch coupled between the source and the load and a controller operable to control the bidirectional semiconductor switch. The load control device may also include a front accessible trimming actuator to adjust a low end intensity setting of the load control device. The trimming actuator may be coupled to the controller such that the controller may control the bidirectional semiconductor switch appropriately. Additionally, the trimming actuator may include indicia to help a user readily identify the proper low end intensity setting.

26 Claims, 4 Drawing Sheets

TWO-WIRE DIMMER SWITCH FOR CONTROLLING LOW-POWER LOADS

CROSS-REFERENCE TO RELATED APPLICATIONS

This application claims the benefit of U.S. Provisional Patent Application No. 61/642,879, filed on May 4, 2012, the disclosure of which is incorporated herein by reference in its entirety.

BACKGROUND

Typically, two-wire dimmer switches are coupled in series electrical connection between an alternating-current (AC) power source and a lighting load for controlling the amount of power delivered from the AC power source to the lighting load. A two-wire wall-mounted dimmer switch is adapted to be mounted in a standard electrical wallbox and comprises two load terminals: a hot terminal adapted to be coupled to the hot side of the AC power source and a dimmed hot terminal adapted to be coupled to the lighting load. In other words, the two-wire dimmer switch does not require a connection to the neutral side of the AC power source (i.e., the load control device is a "two-wire" device). Additionally, typical "three-way" dimmer switches may be used in three-way lighting systems and comprise at least three load terminals, but do not require a connection to the neutral side of the AC power source.

Such dimmer switches typically comprise a bidirectional semiconductor switch, e.g., a thyristor such as a triac or two field-effect transistors (FETs) in anti-series connection. The bidirectional semiconductor switch is coupled in series between the AC power source and the load and is controlled to be conductive and non-conductive for portions of a half cycle of the AC power source to thus control the amount of power delivered to the lighting load. Generally, dimmer switches use either a forward phase-control dimming technique or a reverse phase-control dimming technique in order to control when the bidirectional semiconductor switch is rendered conductive and non-conductive to control the power delivered to the load, and, thus, the lighting intensity of the load. The dimmer switch may comprise an on/off switch or a toggle actuator for turning the lighting load on and off and an intensity adjustment actuator for adjusting the intensity of the lighting load between a minimum intensity and a maximum intensity (i.e., a low-end intensity and a high-end intensity). Examples of prior art dimmer switches are described in greater detail in commonly-assigned U.S. Pat. No. 5,248,919, issued Sep. 29, 1993, entitled LIGHTING CONTROL DEVICE; U.S. Pat. No. 6,969,959, issued Nov. 29, 2005, entitled ELECTRONIC CONTROL SYSTEMS AND METHODS; and U.S. Pat. No. 7,687,940, issued Mar. 30, 2010, entitled DIMMER SWITCH FOR USE WITH LIGHTING CIRCUITS HAVING THREE-WAY SWITCHES, the entire disclosures of which are hereby incorporated by reference.

To save energy, high-efficiency lighting loads such as, for example, compact fluorescent lamps (CFLs) and light-emitting diode (LED) light sources are being used in place of or as replacements for conventional incandescent lamps. High-efficiency light sources typically consume less power and provide longer operational lives as compared to incandescent lamps. In order to illuminate properly, a load regulation device (e.g., such as an electronic dimming ballast or an LED driver) is coupled between the AC power source and the respective high-efficiency light source (i.e., the compact fluorescent lamp or the LED light source) for regulating the power supplied to the high-efficiency light source.

Additionally, a dimmer switch controlling a high-efficiency light source may be coupled in series between the AC power source and the load regulation device for the high-efficiency light source. Some high-efficiency lighting loads are also integrally housed with the load regulation devices in a single enclosure. Such an enclosure may have a screw-in base that allows for mechanical attachment to standard Edison sockets and provide electrical connections to the neutral side of the AC power source and either the hot side of the AC power source or the dimmed-hot terminal of the dimmer switch (e.g., for receipt of the phase-control voltage). The load regulation device is operable to control the intensity of the high-efficiency light source to the desired intensity in response to the conduction time of the bidirectional semiconductor switch of the dimmer switch.

Because high-efficiency lighting loads include load regulation devices, the dimming performance of such high-efficiency light sources typically differs from the dimming performance of conventional incandescent light bulbs. For example, conventional incandescent light bulbs can typically be controlled by a dimmer switch over a wide dimming range—i.e., a high maximum intensity and a low minimum intensity—whereas high-efficiency light sources may require a more narrow dimming range in order to stably maintain the light output. In particular, some high-efficiency light sources require a higher minimum intensity as compared to a conventional incandescent light bulb. In addition, there are many different manufacturers and types of high-efficiency light sources (and accordingly, load regulation devices), and the dimming performance of these light sources varies greatly among one another. These differences in dimming performance of these high-efficiency light sources can cause confusion—and even, frustration—for an end user when using, for example, a dimmer switch. Therefore, there exists a need for an improved two-wire load control device that can properly control the intensity of the high-efficiency light source and is easier for an end user to operate.

SUMMARY

Described herein are load control devices for controlling the amount of power delivered to an electrical load and, in particular, to a two-wire dimmer switch for controlling the intensity of a low-power or high-efficiency lighting load such as an LED light source having an LED driver circuit or a CFL or fluorescent lamp having an electronic dimming ballast. For example, a user may have or may buy a dimmer and may wish to use the dimmer with a low-power or high-efficiency lighting load. To enable the low-power or high-efficiency load to work with a dimmer, the dimmer may include a low-end intensity and/or high-end intensity actuator that may be used in combination with a controller such as a microprocessor to adjust the minimum and/or maximum amount of power a low-end or high-end intensities (e.g., associated with the low-end or high-end dimming intensities) that may be supplied to the low-power or high-efficiency lighting load. For example, the actuator may be adapted to provide a range of low-end intensities associated with a minimum amount of power that may be above a threshold in which the lighting circuit associated with the low-power or high-efficiency lighting load stops working or may be outside a dead space (e.g., from 0-20%, 0-25%, etc.) where the amount of power supplied to the low-power or high-efficiency lighting load may drop out during dimming with the dimmer switch. The controller may further calibrate a range associated with the low-end intensities and/or high-end intensities to provide a suitable or full dimming range for the low-power or high-efficiency lighting load.

For example, a load control device for controlling the amount of power delivered from an AC power source to an electrical load between a minimum and a maximum amount of power may also be provided. The load control device comprises a bidirectional semiconductor switch adapted to be coupled in series electrical connection between the AC power source and the electrical load for conducting a load current from the AC power source to the electrical load. The load control device also has a controller operatively coupled to the bidirectional semiconductor switch. The controller renders the bidirectional semiconductor switch conductive and non-conductive to control the amount of power delivered to the load. The load control device further has an intensity adjustment actuator for controlling the amount of power delivered to the load between the minimum amount of power and the maximum amount of power, and the intensity adjustment actuator is coupled to the controller. The load control device has a trimming actuator for adjusting the minimum amount of power that is delivered to the load, and the trimming actuator is coupled to the controller. The controller may be operable to control the amount of power delivered to the load in response to the intensity adjustment actuator and the trimming actuator. The trimming actuator further includes indicia.

Additionally, a load control system controls the amount of power delivered from an AC power source to an electrical load between a minimum and a maximum amount of power. The load control system comprises a dimmer switch that may be adapted to be partially installed within an electrical wallbox. The dimmer switch has a trimming actuator for adjusting the minimum amount of power that is delivered to the load. The load control system has a wallplate having an adaptor plate adapted to be fixedly attached to the dimmer switch with screws and a front plate adapted to be coupled to the adaptor plate. The front plate may be operable to cover the trimming actuator of the dimmer switch when the front plate is coupled to the adaptor plate. The adaptor plate further has a cutout portion, such that the trimming actuator is accessible through the cutout portion when the front plate may be removed from the dimmer switch and the adaptor plate may be fixedly attached to the dimmer switch.

DETAILED DESCRIPTION

Figure 1:
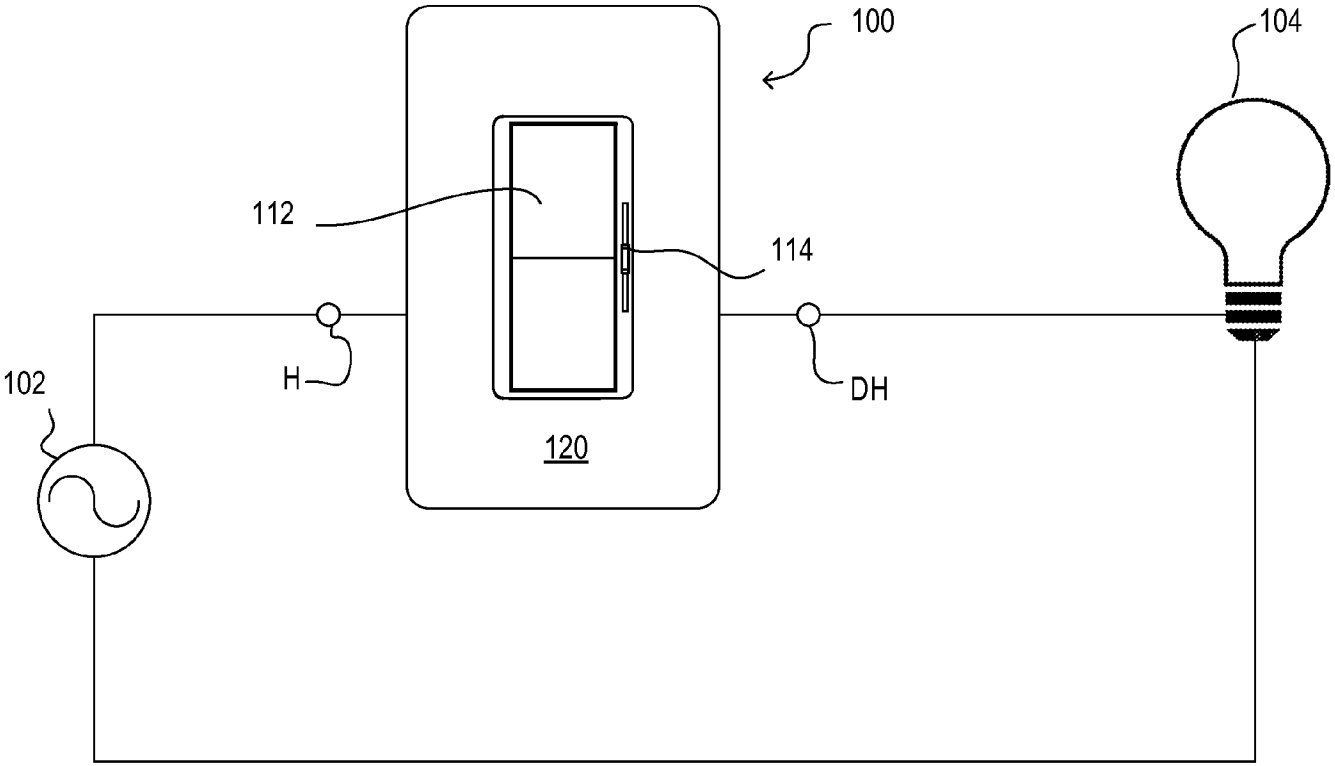
FIG. 1 depicts a diagram of an example lighting circuit including a dimmer switch.

FIG. 1 depicts an example lighting circuit including a "two-wire" dimmer switch 100 for controlling the amount of power delivered from an AC power source 102 to a lighting load 104. The dimmer switch 100 may be operable to be at least partially mounted in a standard electrical wallbox. The lighting load 104 may comprise a high-efficiency lighting load including a load regulation device, e.g., a light-emitting diode (LED) driver or dimming ballast, and a high-efficiency light source, e.g., an LED light source or compact fluorescent lamp. Additionally, the lighting load 104 may comprise a plurality of lighting loads of similar or different types. For example, the lighting loads may include incandescent bulbs, halogen bulbs, gas-discharge lamp, fluorescent lamps, compact fluorescent lamps, LED light sources, low-voltage bulbs with magnetic low-voltage transformers or electronic low-voltage transformers, etc.

The dimmer switch 100 has a hot terminal H adapted to be coupled to the alternating-current (AC) power source 102 for receiving an AC mains line voltage $V_{AC}$, and a dimmed-hot terminal DH adapted to be coupled to the lighting load 104. As shown, the dimmer switch 100 does not require a direct connection to the neutral side N of the AC power source 102. The dimmer switch 100 generates a phase-control voltage $V_{PC}$ (e.g., a dimmed-hot voltage) at the dimmed-hot terminal DH and conducts a load current $I_{LOAD}$ through the lighting load 104. The dimmer switch 100 may either use forward phase-control dimming or reverse phase-control dimming techniques to generate the phase-control voltage $V_{PC}$. Using forward phase-control dimming, the dimmer switch 100 renders a bidirectional semiconductor switch (e.g., a triac) conductive at a firing time (e.g., at a firing angle) each half-cycle of the AC mains line voltage $V_{AC}$. The dimmer switch 100 may adjust the firing time of the phase-control voltage $V_{PC}$ to control the amount of power delivered to the lighting load 104 and thus the intensity of the lighting load.

Generally, a "two-wire" dimmer switch or load control device does not require a direct connection to the neutral side N of the AC power source 102. In other words, all currents conducted by the two-wire dimmer switch must also be conducted through the load. A two-wire dimmer switch may have only two terminals (i.e., the hot terminal H and the dimmed hot terminal DH as shown in FIG. 1). Alternatively, a two-wire dimmer switch (as defined herein) could comprise a three-way dimmer switch that may be used in a three-way lighting system and has at least three load terminals, but does not require a neutral connection. In addition, a two-wire dimmer switch may comprise an additional connection that provides for communication with a remote control device (for remotely controlling the dimmer switch), but does not require the dimmer switch to be directly connected to neutral.

The dimmer switch 100 comprises a user interface having a toggle actuator 112 (e.g., a paddle switch) and an intensity adjustment actuator 114 (e.g., a linear slider). The toggle actuator 112 allows for turning on and off the lighting load 104, while the intensity adjustment actuator 114 allows for adjustment of a target intensity $L_{TRGT}$ of the lighting load 104 from a low-end intensity $L_{LE}$ to a high-end intensity $L_{HE}$. The dimmer switch 100 may adjust the firing angle of the phase-control voltage $V_{PC}$ in response to the target intensity $L_{TRGT}$ to thus control the amount of power delivered to the lighting load 104. Both the toggle actuator 112 and the intensity adjustment actuator 114 extend through the opening of a wallplate 120. Examples of user interfaces of dimmer switches are described in greater detail in commonly-assigned U.S. Pat. No. 8,049,427, issued Nov. 1, 2011, entitled LOAD CONTROL DEVICE HAVING A VISUAL INDICATION OF ENERGY SAVINGS AND USAGE INFORMATION, the entire disclosure of which is hereby incorporated by reference.

Figure 2:
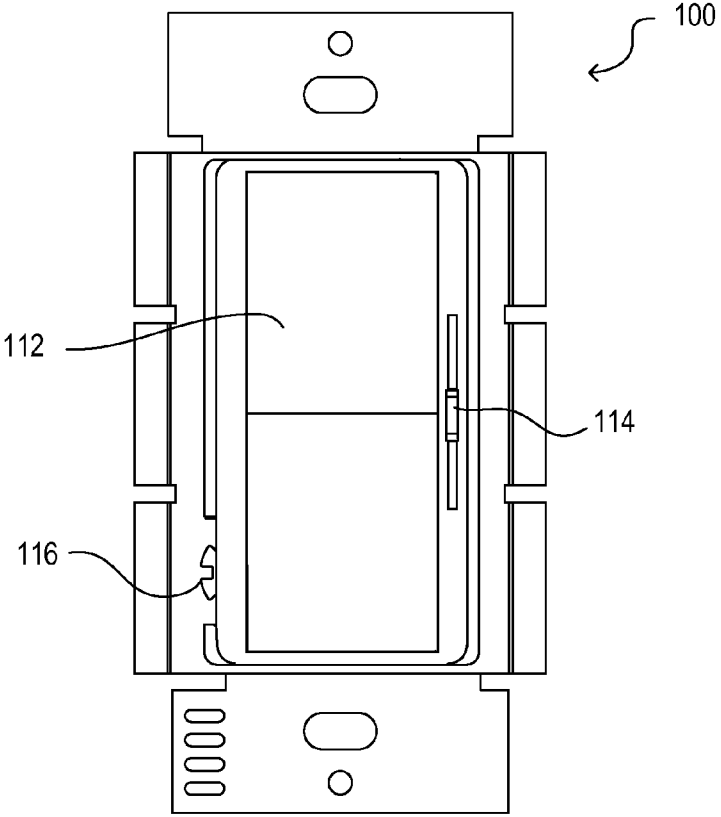
FIG. 2 is a front view of the dimmer switch of FIG. 1.

FIG. 2 is a front view of the dimmer switch 100 without the wallplate 120 installed. The dimmer switch 100 further comprises a trimming actuator 116 (e.g., a dial), which is positioned on an outward-facing surface of the dimmer switch yet is typically covered by the wallplate 120 when the wallplate is installed. The trimming actuator 116 is used to adjust the low-end intensity $L_{LE}$ of the dimmer switch 100 (e.g., between approximately 5% of the maximum intensity and approximately 50% of the maximum intensity). When the trimming actuator 116 of the dimmer switch 100 is rotated in a first direction (e.g., clockwise) and a second direction (e.g., counter-clockwise), the low-end intensity $L_{LE}$ setting of the dimmer switch 110 increases and decreases, respectively. As such, the trimming actuator 116 may be adjusted to change the minimum amount of power delivered to the lighting load without affecting the maximum amount of power delivered to the lighting load. Alternatively or additionally, the trimming actuator 116 may be used to adjust the high-end intensity $L_{HE}$ setting of the dimmer switch 100. The trimming actuator 116 is typically covered by the wallplate 120, because it is not intended to be used regularly by the user.

As previously mentioned, conventional incandescent light bulbs can typically be controlled by a dimmer switch over a wide dimming range. For example, when the installed lighting load 104 shown in FIG. 1 is an incandescent light bulb, the low-end intensity $L_{LE}$ setting of the dimmer switch 100 may be set as low as approximately 5% of the maximum intensity. In other words, the dimmer switch 100 can reliably and stably dim the incandescent light bulb to 5% of its maximum intensity. However, when the installed lighting load 104 is a high-efficiency lighting load, the dimmer switch 100 may not be able to stably dim the high-efficiency lighting load down to 5% of its maximum intensity. When the dimmer switch 100 provides to a high-efficiency light load a phase-control voltage $V_{PC}$ having a firing angle that corresponds to approximately 5% intensity on an incandescent light bulb, the high-efficiency lighting load may flicker and flash instead of providing a constant intensity. For example, the load regulation device of the high-efficiency lighting load may not receive enough power from the phase-control voltage $V_{PC}$ (that has a firing angle corresponding to 5% intensity on an incandescent light bulb) in order to properly operate and/or regulate the lighting intensity of the high-efficiency light source. As a result, the low-end intensity $L_{LE}$ setting of the dimmer switch 100 may be increased, for example, via the trimming actuator 116 to reliably and stably dim the installed lighting load 104 shown in FIG. 1. The low-end intensity $L_{LE}$ setting of the dimmer switch 100 may need to be increased via the trimming actuator 116 (e.g., such that the phase-control voltage $V_{PC}$ has a firing angle corresponding to approximately 20% intensity or greater on an incandescent light bulb) to reliably and stably dim the high-efficiency lighting load. Once this adjustment is made, the intensity adjustment actuator 114 will adjust the intensity of the lighting load 104 between the high-end intensity $L_{HE}$ and the low end intensity $L_{LE}$ (e.g., at which the phase-control voltage $V_{PC}$ has a firing angle corresponding to a 20% intensity).

Additionally, the end user or installer of the dimmer switch 100 may need to experiment with different settings of the low-end intensity $L_{LE}$ in order to find the appropriate setting for the particular lighting load 104 that is installed. For example, upon installation of the dimmer switch 100 or upon installation or replacement of a lighting load 104, a user first turns the lighting load on using the toggle actuator 112. Then, the user may adjust the intensity adjustment actuator 114 to the lowest position (corresponding to the low-end intensity $L_{LE}$). Next, the user may adjust the trimming actuator 116 while monitoring the lighting load 104 to identify the low-end intensity $L_{LE}$ setting that provides both the lowest and most stable light output. Then, the user verifies this setting by actuating the toggle actuator 112 to turn the lighting load 104 off, and then on again. If the lighting load 104 behaves as expected (i.e., turns on and provides a stable, low level out, for example, without flickering), then the user is done. However, if the lighting load 104 does not behave as expected (e.g., flickers or does not turn on), then the user uses the trimming actuator 116 to increase the low-end intensity $L_{LE}$ setting slightly and re-verify the adjusted setting as described above.

Figure 3:
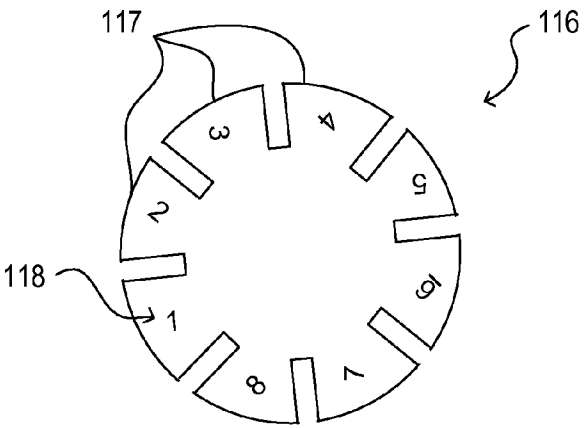
FIG. 3 is a front view of a trimming actuator that may be used in the dimmer switch of FIG. 1.

FIG. 3 is a front view of the trimming actuator 116 removed from the dimmer switch 100 to show the actuator in better detail. The trimming actuator 116 includes a plurality of segments 117 and each segment includes an indicia 118 (e.g., Arabic or Roman numerals, letters, binary, color-code, plus or minus symbols, etc.). Each indicia 118 corresponds to a particular low end intensity $L_{LE}$ setting or power setting. For example, the indicia 118 represented by numeral 1 as shown may correspond to the lowest low-end intensity $L_{LE}$ setting of the intensity of the lighting load, the indicia 118 represented by numeral 8 may correspond to the highest low-end intensity $L_{LE}$ setting of the intensity of the lighting load, and the indicia 118 represented by the numerals therebetween (e.g., 2-7) may correspond to low-end intensity $L_{LE}$ settings (e.g., in intervals) between the lowest low-end intensity $L_{LE}$ setting and the highest low-end intensity $L_{LE}$ setting. As such, a suitable low-end intensity $L_{LE}$ setting that may provide or be associated with a minimum amount of power outside a dead space (e.g., above a threshold where the dimming circuit stops working) of a lighting load such as a high-efficiency lighting load may be used as an input to the controller 210 and may be selected from one of the low-end intensity $L_{LE}$ settings represented by the indicia 118. As shown in FIG. 2, typically only one or two segments 117 of the trimming actuator 116 are visible to the user at a given time. As the user rotates the trimming actuator 116, different segments 117 having different respective indicia 118 become visible. Thus, the indicia 118 help a user more readily identify a low-end intensity $L_{LE}$ setting that provides a stable minimum light output of the lighting load 104 as will be described in further detail below. Alternatively, other structures of trimming actuators could be used. For example, the trimming actuator could comprise a lever, and the indicia 118 could be positioned adjacent to the lever on the dimmer switch 100.

Figure 4:
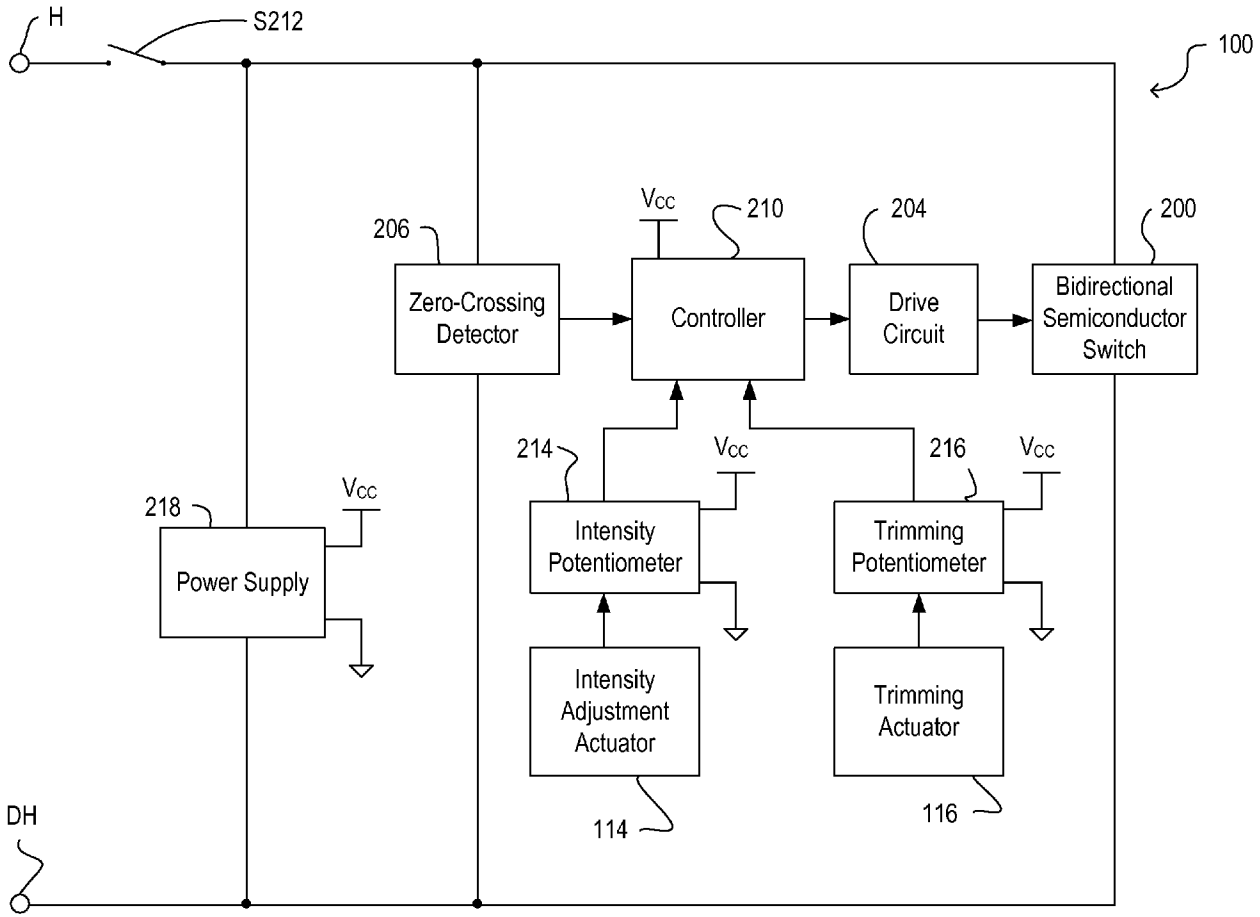
FIG. 4 is a schematic diagram of the dimmer switch of FIG. 1.

FIG. 4 is a simplified block diagram of the dimmer switch 100. The dimmer switch 100 comprises a bidirectional semiconductor switch 200 coupled between the hot terminal H and the dimmed hot terminal DH for generating the phase-control voltage $V_{PC}$ and for controlling of the amount of power delivered to the lighting load 104 shown in FIG. 1. The bidirectional semiconductor switch 200 may comprise a single device such as a triac, or a combination of devices such as two field-effect transistors (FETs) coupled in anti-series connection. The bidirectional semiconductor switch 200 comprises a control input (e.g., a gate), which may receive control signals from a drive circuit 204 for rendering the bidirectional semiconductor switch conductive and non-conductive. The control signals provided by the drive circuit 204 will render the bidirectional semiconductor switch 200 conductive or non-conductive, which in turn controls the amount of power supplied to the lighting load 104. Examples of drive circuits for high-efficiency loads may be found in U.S. application Ser. No. 13/348,324, filed Apr. 27, 2012, entitled TWO WIRE DIMMER SWITCH FOR LOW POWER LOADS, the entire disclosure of which is hereby incorporated by reference.

The drive circuit 204 provides control inputs to the bidirectional semiconductor switch 200 in response to command signals from a controller 210. The controller 210 is preferably implemented as a microcontroller, but may be any suitable processing device, such as a programmable logic device (PLD), a microprocessor, or an application specific integrated circuit (ASIC). The controller 210 provides the control inputs to the drive circuit 204 to operate the bidirectional semiconductor switch 200 (i.e., to provide voltage from the AC power source 102 to the lighting load 104) at predetermined times relative to zero-crossing points of the AC waveform using a phase control dimming technique. A zero-crossing detector 206 determines the zero-crossings of the input AC waveform from the AC power source 102. A zero-crossing is defined as the time at which the AC supply voltage transitions from positive to negative polarity, or from negative to positive polarity, at the beginning of each half-cycle. The zero-crossing information is provided as an input to controller 210.

The dimmer switch 100 further comprises an air-gap switch S212 that is electrically coupled to the hot terminal H and is in series with the bidirectional semiconductor switch 200, such that the lighting load 104 is turned off when the switch is open. When the air-gap switch S212 is closed, the dimmer switch 100 is operable to control the bidirectional semiconductor switch 200 and, thus, to control the amount of power delivered to the lighting load 104. The air-gap switch S212 is mechanically coupled to the toggle actuator 112 of the user interface of the dimmer switch 100, such that the switch may be opened and closed in response to actuations of the toggle actuator.

The dimmer switch 100 further comprises an intensity potentiometer 214 which is mechanically coupled to the intensity adjustment actuator 114, such that as the intensity adjustment actuator is adjusted, a resistance of the intensity potentiometer 214 varies. The intensity potentiometer 214 is coupled to the DC supply voltage $V_{cc}$ and provides an input to the controller 210. For example, the controller 210 may comprise an analog-to-digital convertor (ADC), such that the controller may readily convert a detected voltage value (as affected by the variable resistance) of the intensity potentiometer 214 to a digital value that corresponds to the target light intensity $L_{TRGT}$ of the lighting load 104. The controller 210 then provides the appropriate control signals to the bidirectional semiconductor switch 200 via the drive circuit 204 to achieve the target light intensity $L_{TRGT}$.

The dimmer switch 100 further comprises a trimming potentiometer 216, which is mechanically coupled to the trimming actuator 116, such that as the trimming actuator is adjusted, a resistance of the trimming potentiometer 216 varies. The trimming potentiometer 216 is coupled to the DC supply voltage $V_{cc}$ and provides an input to the controller 210, and may use a separate analog-to-digital (A-to-D) converter on the controller 210, such that the controller may readily convert a detected voltage value (as affected by the variable resistance) of trimming potentiometer 216 to a digital value that corresponds to a desired low-end intensity $L_{LE}$ setting of the lighting load 104. The controller 210 can then use the desired low-end intensity $L_{LE}$ setting to properly scale the dimming range of the dimmer switch 100, such that the movements of intensity adjustment actuator 114 provide smooth dimming from the low-end intensity $L_{LE}$ (e.g., corresponding to or associated with the minimum amount of power delivered to the load) to the high-end intensity $L_{HE}$ (e.g., corresponding to or associated with the maximum amount of power delivered to the load). Alternatively, the trimming potentiometer 216 and/or intensity potentiometer 214 may be implemented as digital encoders, non-contact sensors, and the like.

Because the intensity adjustment actuator 114 and the trimming actuator 116 are coupled to separate potentiometers (i.e., the intensity potentiometer 214 and trimming potentiometer 216, respectively) and the resulting voltage across the resistance of those potentiometers is measured and processed separately by the controller 210, any adjustments made to the low-end intensity $L_{LE}$ setting via the trimming actuator 116 will have no affect on the high-end intensity $L_{HE}$ of the dimmer switch 100. In addition, the controller 210 provides for more accurate adjustment of the low-end intensity $L_{LE}$ setting as compared to using a trimming potentiometer as part of an analog circuit.

Further, the intensity potentiometer 214 and the trimming potentiometer 216 may be calibrated upon the manufacture of the dimmer switch 100 to ensure that the performance of the dimmer switch is consistent across other dimmer switches of the same make. For example, during a calibration process, the controller 210 may determine a minimum and a maximum resistance or power of both the trimming potentiometer 216 and the intensity potentiometer 214 and may store those resistance values to memory. For example, the dimmer switch 100 may comprise an external memory device or the memory may be internal to the controller 210. The controller 210 can then associate the minimum and maximum resistances or power to a predefined range such as a dimming range during this calibration process. Alternatively, during the calibration process, the controller 210 may measure the resulting voltage when the trimming potentiometer 216 and the intensity potentiometer 214 are adjusted to a mid-way (i.e., 50%) state and use the associated mid-way voltage to properly scale a predefined range such as a dimming range of the resistances or power. Thus, the potential effect of any variability (e.g., due to different manufacturing lots, different manufacturers, etc.) between a plurality of trimming potentiometers 216 or a plurality of intensity potentiometers 214 on the operation of the dimmer switch 100 is reduced or eliminated. As a result, the indicia 118 on each segment 117 shown in FIG. 3 of the trimming actuator 116 correspond consistently to a predefined low-end intensity $L_{LE}$ setting suitable for every dimmer switch 100 and/or lighting load 104. For example, the indicia 118 may correspond consistently to the range of low-end intensities $L_{LE}$s or minimum amounts of power suitable for each dimmer switch and lighting load. This can help a user of the dimmer switch 100 more quickly and easily identify the proper low-end intensity $L_{LE}$ setting (e.g., associated with a suitable minimum amount of power) for every dimmer switch and/or lighting load.

For example, if a user has multiple dimmer switches 100 installed in a residence and each dimmer switch 100 is controlling the same type of lighting load 104, then the user can identify the appropriate low-end intensity $L_{LE}$ setting via the trimming actuator 116 for a first dimmer switch 100 while also noting the particular indicia 118 that corresponds to this setting. Then, the user can simply adjust the trimming actuators 116 of the other dimmer switches 100 within the residence to the same setting to achieve the same dimming performance on the other dimmer switches and their respective lighting loads. Alternatively, manufacturers of high-efficiency lighting loads and/or manufacturers of dimmer switches may prescribe low-end intensity settings for various lighting loads, such that a user can simply identify the lamp type in order to find the proper low-end setting and its corresponding indicia 118 to immediately adjust the trimming actuator 116 to the correct setting. For example, manufacturers of dimmers switches may provide indications of the low-end setting and the indicia 118 associated therewith for different lamp types, such that the user can match the lamp type with the correct indication and indicia 118 suitable for the lamp type and may then adjust the trimming actuator 116 to that setting. Further, the packaging of the high-efficiency lighting load may include the recommended low end $L_{LE}$ setting and its corresponding indicia 118. Additionally, the indicia 118 provides more detail to the user regarding the low-end intensity $L_{LE}$ setting of the dimmer switch 100 such that the user can have a more meaningful discussion with another installer or customer service representative, if needed in the event of performance issues.

The trimming actuator 116 could be used to adjust both a low-end intensity $L_{LE}$ setting and a high-end $L_{HE}$ intensity setting of the dimmer switch 100. For example, the user could adjust the intensity adjustment actuator 114 to the lowest position (corresponding to the low-end intensity $L_{LE}$), and then adjust the low-end intensity $L_{LE}$ setting via the trimming actuator 116. Next, the user could adjust the intensity adjustment actuator 114 to the highest position (corresponding to the high-end intensity $L_{HE}$), and then adjust the high-end intensity $L_{HE}$ setting via the trimming actuator 116. Thus, the controller 210 is operable to determine whether the high-end or low-end intensity is being adjusted by evaluating the resistance of the intensity potentiometer 214 (which is controlled by the intensity adjustment actuator 114). Then, the controller 210 evaluates the resistance of the trimming potentiometer 216 to determine the particular desired setting of the high-end or low-end intensity such that the controller can save the desired setting in memory.

Figure 5:
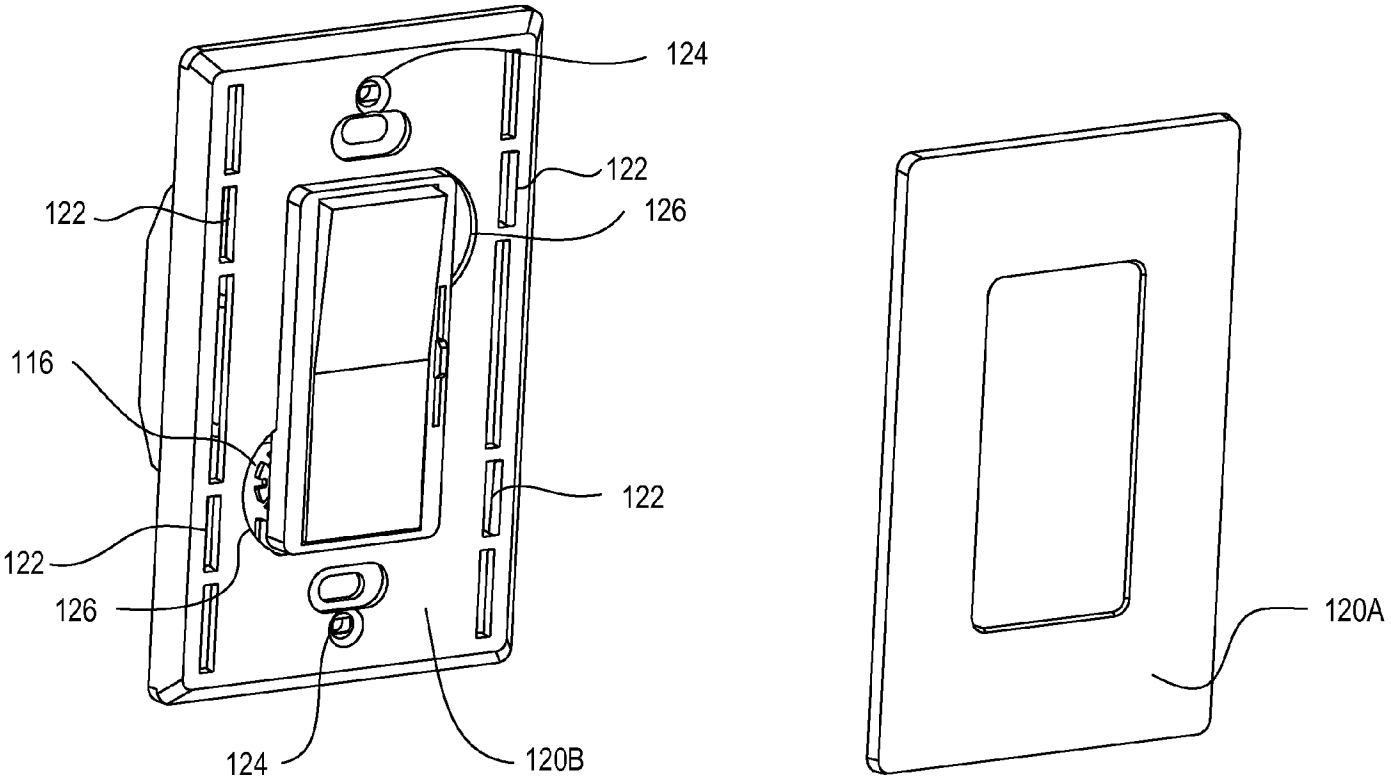
FIG. 5 is an exploded perspective view of the dimmer switch and wallplate of FIG. 1.

FIG. 5 is an exploded perspective view of the dimmer switch 100 and wallplate 120. The wallplate 120 comprises a front plate 120A and an adaptor plate 120B. The adaptor plate 120B comprises circular openings 124 to receive screws (not shown) such that the adapter plate may be fixedly attached to the dimmer switch 100 once the dimmer switch is installed. Alternatively, the adaptor plate 120B could be fixedly attached via screws to an electrical wallbox (not shown) in which the dimmer switch 100 is typically installed. The adaptor plate 120B further comprises a series of rectangular openings 122 that are operable to receive protrusions (not shown) that extend from the rear surface of the front plate 120A such that the front plate can be simply snapped onto the adaptor plate without the use of any additional tools (e.g., screwdriver). Examples of wallplates having a front plate and an adapter plate are described in further detail in U.S. Pat. No. 4,835,343, issued May 30, 1989 entitled TWO PIECE FACE PLATE FOR WALL BOX MOUNTED DEVICE, the entire disclosure of which is hereby incorporated by reference.

The adaptor plate 120B further comprises two cutouts 126. Each cutout 126 is positioned and sized such that the trimming actuator 116 can be adjusted by a user while the adaptor plate 120B is still installed (i.e., fixedly attached via screws to the dimmer switch 100). Thus, if the user needs to access the trimming actuator 116 after the dimmer switch 100 and wallplate 120 have been installed, the user can simply unsnap the front plate 120A from the adaptor plate 120B without using any additional tools. The adaptor plate 120B includes two cutouts 126 such that either vertical orientation of the adaptor plate provides user accessibility of the trimming actuator 116.

The invention claimed is:

1. A load control device for controlling an amount of power delivered from an alternating current (AC) power source to an electrical load between a minimum and a maximum amount of power, the load control device comprising:

a bidirectional semiconductor switch adapted to be coupled in series electrical connection between the AC power source and the electrical load for conducting a load current from the AC power source to the electrical load;

an intensity adjustment actuator for controlling the amount of power delivered to the electrical load between the minimum amount of power and the maximum amount of power;

a trimming actuator for adjusting the minimum amount of power delivered to the electrical load; and a controller operatively coupled to the bidirectional semiconductor switch to render the bidirectional semiconductor switch conductive and non-conductive to control the amount of power delivered to the electrical load, the controller having a first input coupled to the intensity adjustment actuator and a second input coupled to the trimming actuator, wherein the controller is operable to control the amount of power delivered to the electrical load in response to the intensity adjustment actuator and the trimming actuator.

2. The load control device of claim 1, wherein an adjustment of the trimming actuator does not affect the maximum amount of power delivered to the electrical load.

3. The load control device of claim 1, wherein the trimming actuator further includes indicia, the indicia corresponding to different low-end intensity settings associated with different minimum power settings for the minimum amount of power delivered to the electrical load.

4. The load control device of claim 3, wherein the low-end intensity settings comprise at least one low-end intensity setting of at least 20% of a maximum power setting of the electrical load.

5. The load control device of claim 3, further comprising an intensity potentiometer coupled to the intensity adjustment actuator and a direct current (DC) power supply voltage, and wherein the intensity potentiometer is adapted to detect a first voltage value associated with a first resistance from an actuation of the intensity adjustment actuator.

6. The load control device of claim 5, further comprising a trimming potentiometer coupled to the trimming actuator and the DC power supply voltage, and wherein the trimming potentiometer is adapted to detect a second voltage value associated with a second resistance from an actuation of the trimming actuator.

7. The load control device of claim 6, wherein the first input of the controller is coupled to the intensity potentiometer and the second input of the controller is coupled to the trimming potentiometer, wherein the controller is adapted to receive the first and second detected voltage values as inputs on the respective first and second inputs from the intensity potentiometer and the trimming potentiometer, and wherein the controller comprises an analog-to-digital convertor (ADC) adapted to convert the first and second detected voltage values to respective first and second digital values, the first digital value corresponding to a target light intensity for the electrical load and the second digital value corresponding to a desired low-end intensity setting selected from the low-end intensity settings.

8. The load control device of claim 7, wherein the controller is further adapted to scale a dimming range of the load control device between the minimum amount of power and the maximum amount of power delivered to the electrical load based on the second digital value corresponding to the desired low-end intensity setting.

9. The load control device of claim 1, wherein the trimming actuator is further adapted to adjust the maximum amount of power delivered to the electrical load.

10. The load control device of claim 9, wherein the trimming actuator further includes indicia, the indicia corresponding to different high-end intensities associated with different maximum power settings for the maximum amount of power delivered to the electrical load.

11. The load control device of claim 1, wherein the electrical load comprises a low-power lighting load.

12. A load control system for controlling an amount of power delivered from an alternating current (AC) power source to an electrical load between a minimum and a maximum amount of power, the load control system comprising:

a dimmer switch adapted to be partially installed within an electrical wallbox, the dimmer switch having a trimming actuator for adjusting the minimum amount of power that is delivered to the electrical load, wherein the trimming actuator further includes indicia, the indicia corresponding to different low-end intensity settings associated with different minimum power settings for the minimum amount of power delivered to the electrical load; and a wallplate comprising an adaptor plate adapted to be fixedly attached to the dimmer switch and a front plate adapted to be coupled to the adaptor plate, the front plate operable to cover the trimming actuator of the dimmer switch when the front plate is coupled to the adaptor plate, wherein the adaptor plate further comprises a cutout portion such that the trimming actuator is accessible through the cutout portion when the front plate is removed from the dimmer switch and the adaptor plate is fixedly attached to the dimmer switch.

13. The load control system of claim 12, wherein the front plate is adapted to be coupled to the adaptor plate with snaps.

14. The load control system of claim 12, wherein the low-end intensity settings comprise at least one low-end intensity setting of at least 20% of a maximum power setting of the electrical load.

15. The load control system of claim 12, wherein the dimmer switch further comprises a trimming potentiometer coupled to the trimming actuator and a direct current (DC) power supply voltage, and wherein the trimming potentiometer is adapted to detect a voltage value associated with a resistance from an actuation of the trimming actuator.

16. The load control system of claim 15, wherein the dimmer switch further comprises a controller, wherein the controller comprises an input coupled to the trimming potentiometer, wherein the controller is adapted to receive the detected voltage value on the input from the trimming potentiometer, and wherein the controller comprises an analog-to-digital convertor (ADC) adapted to convert the detected voltage value to a digital value corresponding to a desired low-end intensity setting selected from the low-end intensity settings.

17. The load control system of claim 16, wherein the controller is further adapted to scale a dimming range of the dimmer switch between the minimum amount of power and the maximum amount of power delivered to the electrical load based on the digital value corresponding to the desired low-end intensity setting.

18. The load control system of claim 12, wherein the trimming actuator is further adapted to adjust the maximum amount of power delivered to the electrical load.

19. The load control system of claim 18, wherein the trimming actuator further includes indicia, the indicia corresponding to different high-end intensities associated with different maximum power settings for the maximum amount of power delivered to the electrical load.

20. The load control system of claim 12, wherein the electrical load comprises a low-power lighting load.

21. A dimmer switch for controlling an amount of power delivered from an alternating current (AC) power source to a lighting load between a minimum and a maximum amount of power, the dimmer switch comprising:

a bidirectional semiconductor switch adapted to be coupled in series electrical connection between the AC power source and the lighting load for conducting a load current from the AC power source to the lighting load;

an intensity adjustment actuator for controlling the amount of power delivered to the lighting load between the minimum amount of power and the maximum amount of power;

an intensity potentiometer coupled to the intensity adjustment actuator and a direct current (DC) power supply voltage, wherein the intensity potentiometer is adapted to detect a first voltage value associated with a first resistance from an actuation of the intensity adjustment actuator;

a trimming actuator for adjusting the minimum amount of power delivered to the lighting load;

a trimming potentiometer coupled to the trimming actuator and the DC power supply voltage, wherein the trimming potentiometer is adapted to detect a second voltage value associated with a second resistance from an actuation of the trimming actuator; and a controller operatively coupled to the bidirectional semiconductor switch to render the bidirectional semiconductor switch conductive and non-conductive to control the amount of power delivered to the lighting load, wherein the controller comprises a first input coupled to the intensity potentiometer and a second input coupled to the trimming potentiometer, and wherein the controller is operable to control the amount of power delivered to the lighting load in response to the intensity adjustment actuator and the detected first voltage value received on the first input from the intensity potentiometer and in response to the trimming actuator and the detected second voltage value received on the trimming actuator from the trimming potentiometer.

22. The dimmer switch of claim 21, wherein the trimming actuator further includes indicia, the indicia corresponding to different low-end intensity settings associated with different minimum power settings for the minimum amount of power delivered to the lighting load.

23. The dimmer switch of claim 22, wherein the low-end intensity settings comprise at least one low-end intensity setting of at least 20% of a maximum power setting of the lighting load.

24. The dimmer switch of claim 23, wherein the controller comprises an analog-to-digital convertor (ADC) adapted to convert the first and second detected voltage values to a first digital value corresponding to a target light intensity for the lighting load and a second digital value corresponding to a desired low-end intensity setting selected from the low-end intensity settings.

25. The dimmer switch of claim 24, wherein the controller is further adapted to scale a dimming range of the dimmer switch between the minimum amount of power and the maximum amount of power delivered to the lighting load based on the second digital value corresponding to the desired low-end intensity setting.

26. The dimmer switch of claim 21, wherein an adjustment of the trimming actuator does not affect the maximum amount of power delivered to the lighting load.

* * * * *